US007123154B1

(12) United States Patent
Smith

(10) Patent No.: US 7,123,154 B1
(45) Date of Patent: Oct. 17, 2006

(54) REMOTE SENSING AND SIGNALING OF THE PRESENCE OF WILDFIRE

(76) Inventor: Robert J. Smith, 1285 N. Cedar Brook Rd., Boulder, CO (US) 80304

( * ) Notice: Subject to any disclaimer, the term of this patent is extended or adjusted under 35 U.S.C. 154(b) by 110 days.

(21) Appl. No.: 10/792,048

(22) Filed: Mar. 3, 2004

(51) Int. Cl.
*G08B 17/12* (2006.01)

(52) U.S. Cl. ..... 340/600; 340/501; 340/506; 340/539.27; 340/577; 340/589

(58) Field of Classification Search ..... 340/600, 340/628, 632, 501, 506, 577, 581, 584, 589, 340/539.19, 539.27, 539.28; 169/5, 13
See application file for complete search history.

(56) References Cited

U.S. PATENT DOCUMENTS 4,016,424 A * 4/1977 Traina ..... 250/372
4,251,810 A * 2/1981 Wyatt ..... 340/612
5,165,482 A 11/1992 Smagac et al.
5,931,233 A 8/1999 La Bonte et al.
6,742,305 B1 * 6/2004 Rogers et al. ..... 52/3

OTHER PUBLICATIONS

Hamamatsu, Flame Sensor UV TRON R2868 spec sheet, Mar. 1998, Hamamatsu Specification Sheet.

Hamamatsu, UV TRON Driving Circuit C3704 Series spec sheet, Jul. 1997, Hamamatsu Specification Sheet.

Jursa, Handbook of Geophysics and the Space Environment, 1985, Air Force Geophysics Laboratory, Air Force Systems Command, United States Air Force, Chapter 22, Atmospheric Emission and Absorption of Ultraviolet Radiation, pp. 22-1 throught 22-7.

US Air Force, Absoption by Atmosphric Gases in UV and Visible, Web Site www/heliosat3.de/e-learning/radiative-transfer/rt/, Sep. 27, 2000, Lecture 9, pp. 1-8.

* cited by examiner

*Primary Examiner*—Hung Nguyen
(74) *Attorney, Agent, or Firm*—Pritzkau Patent Group, LLC.

(57) ABSTRACT

Detecting a wildfire and an electrical arc, which are characterized by emission of ultraviolet (UV) radiation at a given wavelength, are described using a light sensor having a pulse output responsive to the given wavelength and generating an intermediate output responsive to the pulse output in a way which tracks a trend in the pulse output, irrespective of any increase in the relative number of pulses in the pulse output that is responsive to extraneous sources other than wildfire or electrical arc. The intermediate output is generated responsive to pulses occurring within an event window that continuously terminates at present time and extends backward therefrom by a selected time duration. An alarm signal is produced based on a predetermined characteristic of the intermediate output. Packaging of the sensor and alarm arrangement is described along with photo-detection tube optimization. Further, atmospheric transmission of the detected wavelength is described.

16 Claims, 5 Drawing Sheets

REMOTE SENSING AND SIGNALING OF THE PRESENCE OF WILDFIRE

BACKGROUND OF THE INVENTION

The present invention relates generally to fire detection systems and, more specifically, to fire detection systems for sensing the presence of fire and/or precursors thereof which are located remotely therefrom.

As more residences are built in forested parts of the country, the danger of wildfire becomes ever more ominous due to the number of lives and properties that are at risk. Particularly in dry or windy times and locations, a wildfire can double in size every few minutes. Without early detection, such a fire can quickly overwhelm any resources available to fight the fire. Early detection by a homeowner can in many cases ensure notification of the fire department while the fire is still small enough to be stopped or, if necessary, an emergency evacuation by the homeowner. However, no homeowner can be constantly on the lookout for wildfires, particularly at night. It is well known that wildfires may grow exponentially in dry weather, steep terrain or in high winds. Due to the exponential growth of wildfires, a wildfire must be attacked early or it quickly grows too large and hazardous for a direct attack.

Early attack of a wildfire depends on early detection. For example, if a one-foot fire doubles its diameter every five minutes, it would take 39 minutes to become a one acre blaze, then quickly blows up to 100 acres in the next 16 minutes. Since fire department response times are typically 20 minutes and such quickly-growing fires cannot be safely attacked beyond approximately two acres in size, the fire must be detected and the fire department notified within the first 20 minutes of the fire or the opportunity to stop the fire will have passed. The doubling time can be much shorter in high wind conditions. High winds are additionally dangerous since they often initiate power line arcing, which may cause the power line to break and fall to the ground, thereby immediate setting light fuels on fire. Therefore, it would be desirable to detect power line arcing, even if a fire has not yet started. Then, fire crews may wet down areas downwind of an arcing wire before a fire has begun.

An optical detection method for detecting wildfires at long distances is preferable so that the detector does not have to rely on smoke, heat or other indicators of fire. While fires emit light in the visible spectrum, most of the emitted radiation is in the infrared portion of the electromagnetic spectrum. Consequently, many fire detection systems rely on the detection of infrared radiation. However, various other warm or hot objects, such as the sun or its reflections, also emit large quantities of infrared radiation. Therefore, the infrared radiation sources must be distinguished spatially, and an array-type detector with an imaging and/or scanning system is often used for this purpose. Since the signal processing for such an array-type infrared detector is complex, these systems are generally expensive. Furthermore, these infrared detection systems are ineffective in detecting electrical arcs, which have low infrared emissions. Also, although some bands of the infrared spectrum (such as the 2.7 μm, 4.3μm and 6.5μm bands) are "solar blind" to some extent because the atmosphere blocks sunlight at those wavelengths and thereby prevents these solar wavelengths from reaching the ground, the usefulness of these infrared detectors in long-distance wildfire detection is limited since the atmosphere also blocks these wavelengths when they are emitted by a fire.

While numerous flame sensors , many of which respond to UVC photons emitted by hydrocarbon flames, are commercially available, these sensors are typically designed to respond to flames within approximately fifty meters. To be useful, however, a wildfire sensor should detect fires at much longer distances, for example, up to a mile away. Also, a wildfire sensor should be capable of detecting small electrical sparks, such as from arcing power lines, which are common precursors to wildfires. Given geometrical considerations, one might logically assume that a sensor which detects a 0.01 meter diameter flame at 5 meters would be capable of detecting a 1.0 meter diameter flame at 500 meters and, by extension, a 10 meter flame at 5000 meters. However, in the case of UVC detection, atmospheric oxygen absorbs approximately half of the UVC signal every 160 meters, and, additionally, the terrestrial half-power point of UV due to $O_2$ absorption increases dramatically with wavelength (e.g., the half power point is approximately 60 meters for a wavelength of 210 run, 130 meters at 220 nm, 230 meters at 230 nm, 480 meters at 240 nm, 1150 meters at 250 nm, etc.). In other words, over the course of a one mile path for a UVC wavelength of approximately 225nm as an example, 99.9% of the UVC signal is absorbed by the atmosphere (UVC is substantially blocked by stratospheric ozone), thereby leaving just one tenth of one percent for detection. Moreover, currently available UV detectors are limited in usefulness in sunlight because the sun also radiates ultraviolet radiation. Since sunlight contains ultraviolet radiation in the UVC and UVC as well as UVC ranges, a UV detector for detection of weak and/or distant flames or arcs must be able to ignore UVA and UVB radiation while being sensitive to UVC radiation such that the sensor is essentially blind to sunlight but is highly sensitive to both flames and electrical arcs. That is, the sensor must be highly sensitive in a range within the UVC range (particularly from 230nm to 280nm which are not absorbed by $O_2$) while exhibiting much lower responsivity at wavelengths, for example, longer than 280nm that are not absorbed by $O_3$.

In order for a UV sensor to detect weak and/or distant flame or electrical arc, the sensor must be highly sensitive to a selected range of UVC radiation. However, most UVC radiation is blocked by tropospheric atmosphere, particularly by oxygen. Since there exists significant overlap between the absorption bands of tropospheric oxygen ($O_2$) and stratospheric oxygen ($O_3$), an ideal UV sensor should operate in a spectral region between 240 nm and 270 nm in order to remotely detect the presence of wildfire and/or electrical arc.

Unfortunately, ideal detectors which operate in this limited ultraviolet radiation range are not currently available. While highly effective, absorptive bandpass filters of cobalt glass are available, no such filter is currently available with such exacting specifications. As an alternative, interference filters may be designed to specifically pass only wavelengths between 240nm and 270nm, but interference filters are expensive, have limited field of view (i.e., exhibits high angle sensitivity) and generally do not provide sufficient wavelength rejection at wavelengths longer than 280 nm. The angle sensitivity is particularly problematic in fire detection since it is desirable to have one detector to cover a large angular field of view.

Recently, specialized semiconductor photodiodes have been developed under DARPA with the goal of targeting the UVC band of wavelengths which is substantially blocked by stratospheric $O_3$ but is largely transmitted by tropospheric $O_2$. The efforts are generally aimed at purposes of, for example, tracking missiles and other such projectiles. However, the UVB rejection of such photodiodes thus far has been limited to approximately 30 dB. Such values of UVB rejection may suffice for military purposes, but effective detection of distant wildfires and electrical arcs would require that the response to UVB relative to the desired band of UVC radiation should be reduced at least 25 dB at 280 nm, 45 dB at 290 nm, 75 dB at 300 nm, 90 dB at 310 nm and 100 dB at 320 nm. Very few detectors can meet such UVB rejection requirements, and still fewer achieve such values of UVB radiation rejection over a hemispherical field of view. Additionally, since the spectral emissions of various hydrocarbon flames may or may not be adequately similar and the UVC emissions from such flames are largely re-absorbed on passage through the plasmas of the various flames, the UV spectra of various flames may differ.

Various types of UVC photo-electric avalanche detectors are available. Turning now to the drawings, where like items are indicated by like reference numbers, a typical photo-electric avalanche detector is shown in FIG. 1, indicated by a reference numeral 10. Photo-electric avalanche detector 10 includes a glass envelope 12 enclosing a plurality of avalanche gas atoms 14, as well as an anode 16 and a photo-cathode 18, and photo-electric avalanche detector 10 is sensitive to a signal photon 20. An electric field 22 (indicated by arrows) is established between the anode and the photo-cathode by a bias voltage applied therebetween (not shown). When signal photon 20 is incident on photo-cathode 18, thereby knocking off an electron from the cathode, electric field 22 produces an electron avalanche, thereby leading to the detection of the signal photon. As will be further described, an electric field is easily overwhelmed by the presence of noise sources.

In a conventional "photon counting" mode of operation of a UVC photo-electric avalanche detector, the presence of extraneous noise counts precludes simply increasing the circuit gain in order to compensate for reduced signal levels. As a result, detection of small or distant fires is difficult at best and typically fraught with the problem of unacceptable false alarms.

One type of photo-electric avalanche detector is the Geiger-Mueller detector, which was originally invented in 1928 for detection of gamma rays. Geiger-Mueller detectors (or GM tubes) can and have been adapted for use as UV detectors. These adapted GM tubes employ the photoelectric effect to strongly reject photons whose energies fall below the work function of a photocathode. Like the original GM tubes, these adaptations employ a low pressure gas to achieve avalanche gain in a strong electric field when an incident UV photon of the correct wavelength succeeds in knocking loose an electron from the photocathode. As different photocathode metals exhibit different work functions, different GM tubes may detect different UV wavelengths. For example, nickel ideally rejects any wavelength longer than 247nm; tungsten ideally rejects any wavelength longer than 274nm; and molybdenum ideally rejects any wavelength longer than 295nm. However, when placed at above absolute zero temperatures and due to crystal structure imperfections, these cut-off wavelength values blur considerably. Furthermore, although GM tubes commonly exhibit a response peak at around 200nm, the presence of atmospheric O2 shifts the peak of the already weak UV signal from a fire toward 250nm. As a result, the rather unpredictable response of GM tubes to solar UVB radiation around 280 nm becomes critical to maintaining an acceptable signal-to-noise (SNR). For instance, although nickel cathode GM tubes have a much lower response to ultraviolet radiation at 250 nm in comparison to molybdenum or tungsten based devices, nickel devices may also exhibit a high enough responsivity to solar radiation greater than 280 nm so as to make the SNR of the device intolerable in remote fire detection applications. Poisson or "shot" noise in the signal as well as cosmic ray background noise becomes problematic in the attempt to extract the fire signal from the background noise.

One example of a compact GM tube for use in fire detectors and alarms is UV TRON® R2868 available from Hamamatsu Corporation. According to the specification provided with the device, the R2868 exhibits a narrow spectral sensitivity in the 185 to 260nm range with a wide angular sensitivity so as to detect, for example, a cigarette lighter flame at "a distance of more than 5 m" and "corona discharge of high-voltage transmission lines."[1] However, the specification of R2868 lists the background noise characteristic of the device at 10 cpm Max under room illumination and operating conditions. Since the background noise characteristic further worsens in sunlight conditions, this background noise characteristic of R2868 as supplied by the manufacturer is unacceptable in detecting the presence of wildfire and electrical arcs at long distances. Also, the driver/processor circuit available from Hamamatsu for use with R2868 employs a fixed integration period time integration circuit which triggers the generation of an alarm signal when the photon count received at R2868 reaches a user-specified threshold value during a given integration period. In the Hamamatsu driving circuit, if the photon count is even just slightly below the threshold value at the end of any given integration period, then the photon count is reset to zero at the end of the integration period. This time integration method is inadequate for use in the long distance detection of wildfires and flames because the photon count over time may be very low for a long period of time but increase exponentially over a short time period. Since early detection is key in this application, the resetting of the photon count at the end of each integration period may lead to the loss of precious time in detection of far away but significant fire sources.

[1]HAMAMATSU Flame Sensor UV TRON® R2868 Specification sheet.

Furthermore, since it is very common for wildfires to be caused by a downed power line, it is highly desirable for a wildfire alarm system to be battery operated. However, this feature proves difficult since conventional circuitry, even of low power, CMOS variety, may consume enough power to require unacceptably frequent battery replacement.

The present invention provides a fire detection apparatus and associated method which serves to reduce or eliminate the foregoing problems in a highly advantageous and heretofore unseen way and which provides still further advantages.

SUMMARY OF THE INVENTION

As will be disclosed in more detail hereinafter, there is disclosed herein a method for use in an apparatus for detecting the presence of a wildfire located remotely therefrom. The wildfire and electrical arc are characterized by emission of ultraviolet (UV) radiation at a given wavelength. The method includes providing a light sensor having a pulse output responsive to the given wavelength and generating an intermediate output responsive to the pulse output in a way which tracks a trend in the pulse output, irrespective of any increase in the relative number of pulses in the pulse output that is responsive to extraneous sources other than wildfire or electrical arc. The intermediate output is generated responsive to pulses occurring within an event window that continuously terminates at present time and extends backward therefrom by a selected time duration. The method further includes producing an alarm signal based on a predetermined characteristic of the intermediate output.

In another aspect of the invention, the method includes providing a Geiger-Mueller tube (GM tube) having a given response at a maximum rated bias voltage when exposed to the given wavelength, as well as when concurrently exposed to a plurality of extraneous noise sources, for use in generating a pulse output. The method also includes operating the GM tube in a way which produces a modified response of the GM tube, thereby increasing sensitivity of the GM tube over the given response with respect to the given wavelength as well as with respect to the plurality of extraneous noise sources so as to increase a relative number of pulses in the pulse output responsive to the given wavelength and responsive to the extraneous noise sources, as compared to operating the GM tube at the maximum rated bias voltage. The method further includes generating an intermediate output responsive to the pulse output in a way which tracks a trend in the pulse output, which trend is generally responsive to the presence of at least one of the wildfire and electrical arc, irrespective of the increase in the relative number of pulses in the pulse output that are responsive to the extraneous sources, and producing an alarm signal based on a predetermined characteristic of the intermediate output.

In still another aspect of the invention, an apparatus for detecting at least one of a presence of a wildfire and an electrical arc located remotely therefrom is disclosed. The wildfire and electrical arc are characterized by emission of ultraviolet (UV) radiation at a given wavelength. The apparatus includes a Geiger-Mueller tube (GM tube), which GM tube exhibits a given response at a maximum rated bias voltage when exposed to the given wavelength as well as when concurrently exposed to a plurality of extraneous noise sources for use in generating a pulse output. The apparatus also includes a driver for operating the GM tube in a way which produces a modified response of the GM tube, thereby increasing sensitivity of the GM tube over the given response with respect to the given wavelength as well as with respect to the plurality of extraneous noise sources so as to increase a relative number of pulses in the pulse output responsive to the given wavelength and responsive to the extraneous noise sources, as compared to operating the GM tube at the maximum rated bias voltage. The apparatus further includes a processing circuit for generating an intermediate output responsive to the pulse output in a way which tracks a trend in the pulse output, which trend is generally responsive to the presence of at least one of the wildfire and electrical arc, irrespective of the increase in the relative number of pulses in the pulse output that are responsive to the extraneous sources, and an alarm apparatus for producing an alarm signal based on a predetermined characteristic of the intermediate output.

In yet another aspect of the invention, a sensor for use in an apparatus for detecting a presence of at least one of a wildfire and an electrical arc located remotely therefrom is disclosed, which wildfire and electrical arc are characterized by emission of ultraviolet (UV) radiation at a given wavelength. The disclosed sensor includes a photo-electric avalanche tube (GM tube) including a light transmissive enclosure and a detecting arrangement disposed therein to provide a given wavelength response at a given bias voltage when exposed to the UV radiation of the given wavelength and also providing a noise response when exposed to a plurality of extraneous noise sources, and a material applied to the enclosure in a way which limits the noise response with respect to at least certain ones of the plurality of extraneous noise sources while maintaining, at least approximately, the given wavelength response to the UV radiation of the given wavelength.

In a further aspect of the invention, an apparatus for detecting a presence of at least one of a wildfire and an electrical arc located remotely therefrom is disclosed, the wildfire and electrical arc being characterized by emission of ultraviolet (UV) radiation at a given wavelength. The apparatus includes a UV sensor responsive to UV radiation at the given wavelength and being configured to produce a response when the UV radiation of the given wavelength is incident thereon, and an integrator section configured for receiving the response and integrating the response over time in a particular way so as to produce an alarm signal when the response reaches a predetermined threshold value.

In a yet further aspect of the invention, an apparatus for detecting a presence of at least one of a wildfire and an electrical arc located remotely from a portion of a structure having a thickness extending between an exterior surface and an interior surface is disclosed. The wildfire and electrical arc are characterized by emission of ultraviolet (UV) radiation at a given wavelength. The apparatus includes a first, exterior arrangement configured for removable attachment to the exterior surface of the portion of the structure. The first, exterior arrangement includes at least a UV sensor for producing a response when the UV radiation at the given wavelength is incident thereon. The apparatus further includes a second, interior arrangement configured for removable attachment to the interior surface of the structural member, and a communication configuration forming part of the first, exterior arrangement and forming part of the second, interior arrangement at least for transmitting the response from the UV sensor to the second, interior arrangement for use thereby through the portion of the structure.

In a still further aspect of the invention an apparatus for detecting a presence of at least one of a wildfire and an electrical arc located remotely from a structure is disclosed, the wildfire and electrical arc being characterized by emission of an ultraviolet (UV) radiation of a given wavelength. The apparatus includes a sensor for producing a response when the UV radiation of the given wavelength is incident thereon, and a discriminator circuit for receiving the response and integrating the response using exponentially decaying time integration so as to produce an alarm signal when the response reaches a predetermined threshold value.

In another aspect of the invention, a method is disclosed for modifying a responsivity characteristic of a radiation sensor, the radiation sensor having a maximum rated bias voltage and initially exhibiting a given wavelength response that varies over a range of tolerance. The method includes applying a pre-conditioning voltage to the radiation sensor, the pre-conditioning voltage being higher than the maximum rated bias voltage, and simultaneously with the application of the pre-conditioning voltage, exposing the radiation sensor to light of a given wavelength range such that the radiation sensor becomes substantially insensitive to light of the given wavelength range.

In still another aspect of the invention, a method is disclosed for detecting a presence of at least one of a wildfire and an electrical arc burning proximate to Earth's surface. The method includes selecting a detection wavelength that is emitted by wildfire and electrical arc and which transmits in a first way at the Earth's surface as a result of a first ratio of oxygen compounds proximate to the surface of Earth, but which detection wavelength transmits in a second way in Earth's stratosphere based on a second, different ratio of oxygen compounds present in Earth's stratosphere. The method also includes using a detection arrangement positioned such that the detection wavelength travels from the wildfire to the detection arrangement in the presence of the first ratio of the oxygen compounds and so that sunlight arriving at the detection arrangement travels through Earth's stratosphere so as to subject the sunlight to the second ratio of oxygen compounds in a way which attenuates content of the detection wavelength, in sunlight, and configuring the detection arrangement to respond at the detection wavelength so as to enhance a detection response to the wildfire while attenuating the response to the detection wavelength to sunlight based on the first and second ratios of the oxygen compounds.

BRIEF DESCRIPTION OF THE DRAWINGS

The present invention may be understood by reference to the following detailed description taken in conjunction with the drawings briefly described below.

DETAILED DESCRIPTION

The following description is presented to enable one of ordinary skill in the art to make and use the invention and is provided in the context of a patent application and its requirements. Various modifications to the described embodiments will be readily apparent to those skilled in the art and the generic principles herein may be applied to other embodiments. Thus, the present invention is not intended to be limited to the embodiment shown but is to be accorded the widest scope consistent with the principles and features described herein.

It would be desirable to obtain a compact system for wildfire detection which is suitable for use by a typical homeowner and is readily mountable by, for example, hook-and-loop attachment to the outside and/or inside of a window.

The present invention provides a way to increase the sensitivity of a photo-electric avalanche tube (GM tube) to the UVC photons associated with flames or electrical sparks, while simultaneously suppressing the number of "noise" counts associated with effects unrelated to the flame or sparks. That is, the target wavelength for detection in the present invention is in the UVC wavelength range, which is emitted by fire and electrical arc sources, well-transmitted through the atmosphere and is substantially absent from sunlight received at ground levels primarily due to absorption by the stratospheric ozone layer. Typically, a GM tube manufacturer specifies a recommended anode-to-cathode voltage, as well as a maximum voltage ($V_{max}$), above which the tube should not be operated due to the increased incidence of noise counts. This $V_{max}$ value is usually the operating voltage value above which the noise level becomes unacceptably large in a particular application. The manufacturer recommended voltage usually represents a compromise between acceptably high sensitivity to ultraviolet photons and low sensitivity to extraneous noise sources. However, Applicant has found that a sensor with its operating voltage set conservatively with respect to the V. typically detects less than one photon per minute from a ten meter fire located one mile away. This rate of detection is well within typical noise range, therefore the detected wildfire signal would be indistinguishable from background noise.

Figure 2:
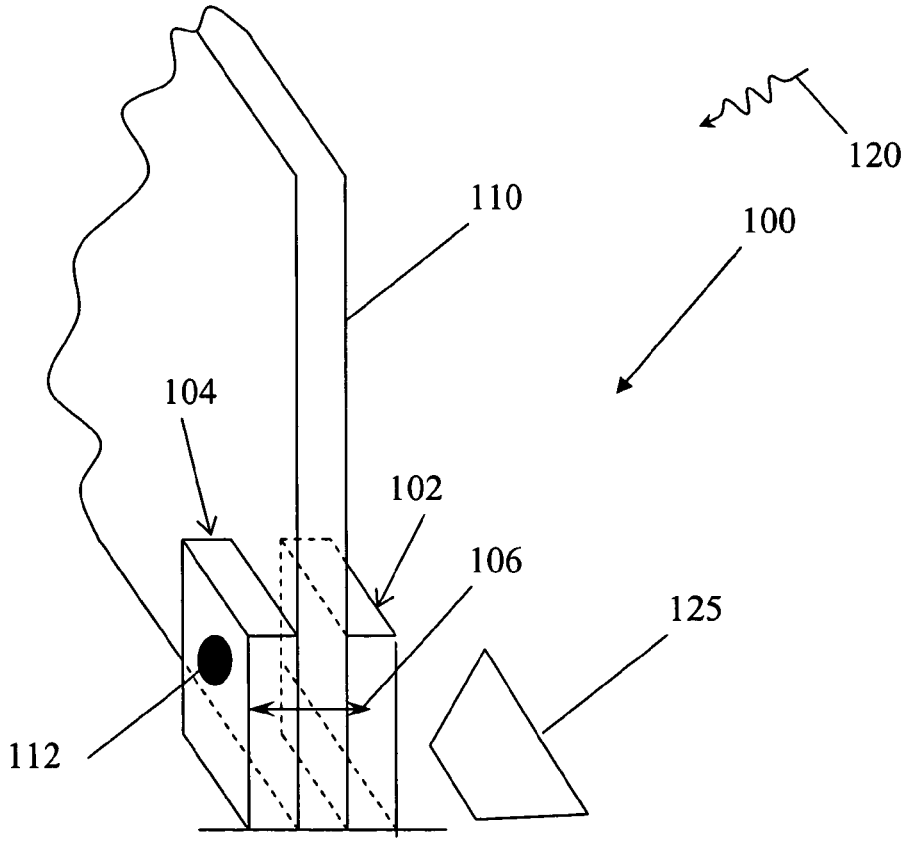
FIG. 2 is a partial cut-away view of a configuration of a long-distance flame and electrical arc detector of the present invention.

FIG. 2 shows a diagrammatic, partial cut-away view of a long distance flame detection system 100 of the present invention. System 100 includes an exterior portion 102 and an interior portion 104 which are linked together by a link (indicated by a double-headed arrow 106). Link 106 may be, for example, a wire connection or an optical interlink. Exterior portion 102 and interior portion 104 are mounted on opposite sides of a portion of a structure 110, such as a window or a wall, by means of affixing such as, for example, hook and loop attachments, screws, nails, and/or tape. Exterior portion 102 includes an arrangement for UVC photon detection, such as a GM tube (not visible in this view), and is mounted on the exterior of structure 110 (e.g., outside of a house) in order to enable detection of weak UVC radiation, which is substantially blocked by, for instance, window glass. Interior portion 104 is mounted on the interior of structure 110 (e.g., inside of the house), and includes, for instance, a visual and/or audible alarm 112 to alert an occupant to the presence of a flame external to the house. When a photon 120 within a wavelength range indicative of a flame or electrical arc is received at exterior portion 102, the UVC photon detection mechanism detects the photon and, in accordance with a time integration and event processing method provided by the present invention, determines if the issue of an alarm signal is warranted. Such an alarm signal, if generated, is communicated to interior portion 104 so as to trigger alarm 112. Alternatively, the exterior portion may only contain a UVC photon detector which is configured to direct a signal, via link 106, to the interior portion containing the time integration and event processing circuitry as well as an alarm signal generating apparatus. Additionally, a shield 125 may be attached to the structure itself or the exterior or interior portion so as to block potential UVC radiation from safe UVC sources, such as barbecue grills. The details of the various portions of the system of the present invention are discussed in further detail immediately hereinafter.

Figure 1:
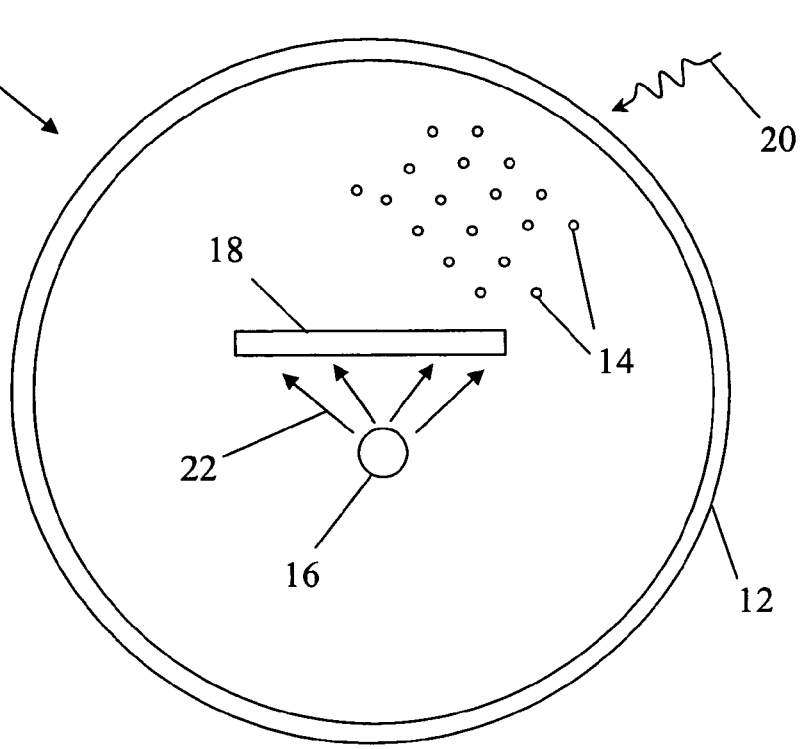
FIG. 1 (PRIOR ART)
FIG. 1 is a diagrammatic view of a conventional photo-electric avalanche detector.
Figure 3:
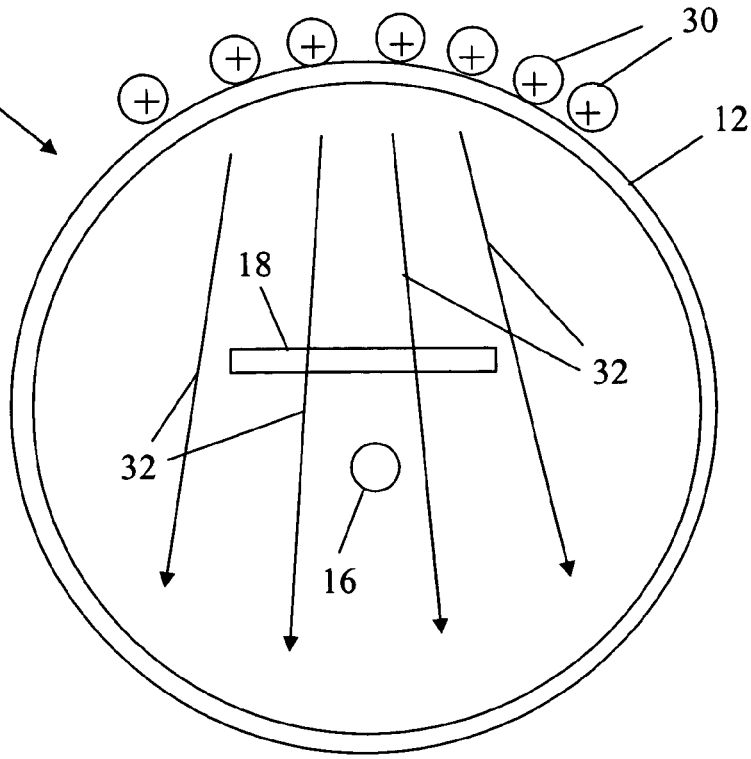
FIG. 3 is a diagrammatic view of the conventional photo-electric avalanche detector in the presence of noise source resultant static electric field.
Figure 4:
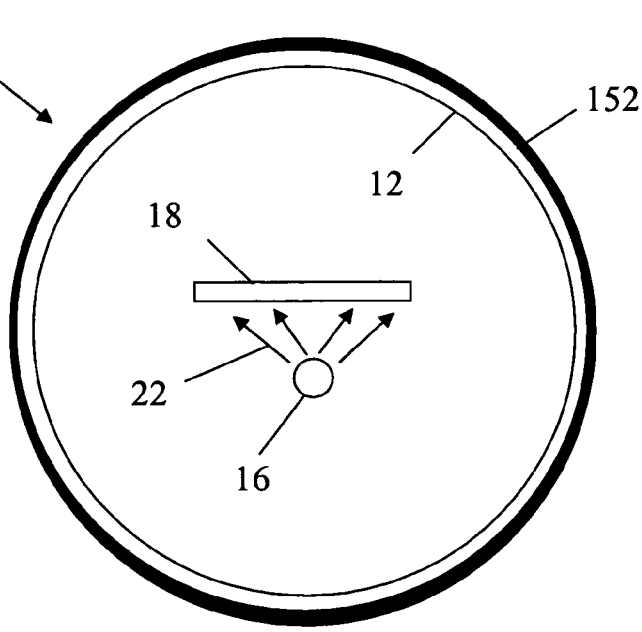
FIG. 4 is a diagrammatic view of a photo-electric avalanche detector including an antistatic coating in accordance with the present invention.

In order to substantially raise the GM tube sensitivity to UVC photons in the system, the method under discussion includes raising the operating voltage substantially beyond the recommended maximum voltage value by, for example 20%. This practice alone, however, generally results in an unacceptably high rate of noise counts. Furthermore, FIG. 3 illustrates a case where the presence of a plurality of static charges, generally indicated by reference numeral 30, cause the generation of a static field 32 within photo-electric avalanche detector 10'. Such static fields may be generated by, for example, friction with other materials present in the vicinity, particularly moving air (i.e., wind shear), and noise due to static fields may overwhelm the presence of a weak detected signal. Therefore, additionally, the method includes the application of a UVC-transmitting, anti-static coating on the surface of the GM tube as well as in the general vicinity of the tube. A modified GM tube including an anti-static coating is shown in FIG. 4. A GM tube 150 is essentially the same as photo-electric avalanche tube 10 of FIG. 1, but includes an anti-static coating 152 on glass envelope 12. This coating may be electrically conductive (e.g., a thin layer of indium tin oxide) so as to disperse surface electrical charge, or may incorporate cations so as to neutralize negative electrical charge. In either approach, the aim is to minimize or eliminate the generation of static electric fields within the tube due to friction with other materials, particularly moving air (i.e., winds). Without this coating, the static electric field can overwhelm the intentional anode-to-cathode field that is critical to the proper operation of the GM tube. Since such electric fields combine vectorially, the static and the intentional fields may add (in which case the anode discharges without the presence of a UVC photon) or the fields may subtract (in which case the GM tube fails to properly discharge in the presence of a UVC photon). This combination of an appropriately increased operating voltage to increase the anode-to-cathode field used in conjunction with the reduction or elimination of friction-generated count results in a significant increase in sensitivity of the GM tube to UVC radiation, while avoiding the otherwise inevitable increase in friction-static noise counts which produce unacceptable false alarms.

Figure 5:
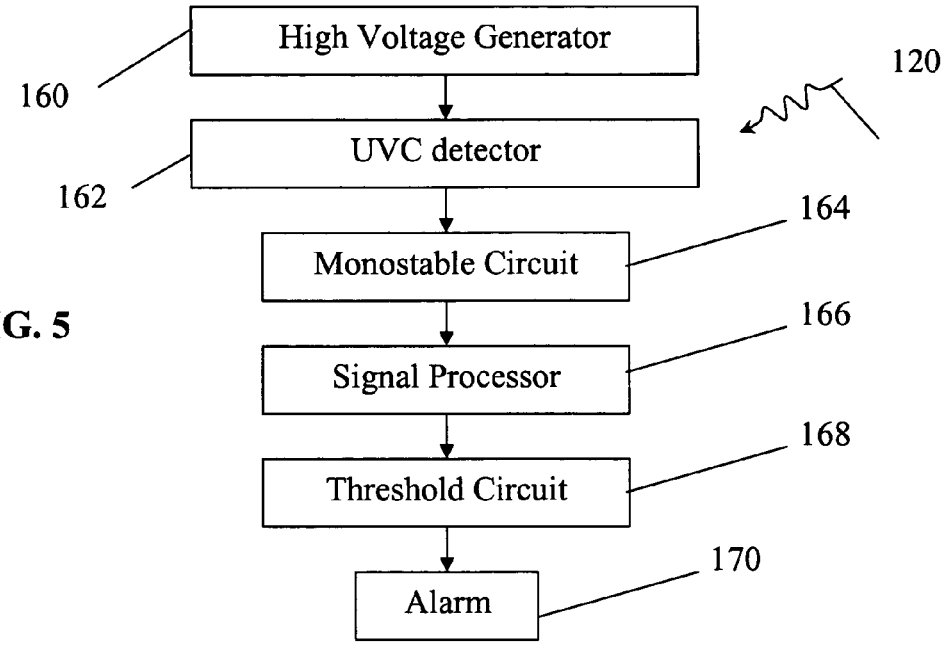
FIG. 5 is a block diagram illustrating the components of one configuration of the long-distance flame detector of the present invention.

Another aspect of the present invention provides a signal processor ideally suited to the problem of detecting wildfires and electrical sparks. The main components of the long distance flame detection system of the present invention are outlined in a block diagram in FIG. 5. It is considered that one having ordinary skill in the art will be enabled to provide and interface these various functional blocks in light of this overall disclosure. The long distance flame detection system of the present invention includes a high voltage generator 160 driving a UVC detector 162, such as photo-electric avalanche tube 150 of FIG. 4 (or an equivalent thereof, having the desired UVC responsivity characteristics as described below). UVC radiation 120 detected at UVC detector 162 is processed through a monostable circuit 164, which is triggered by, for example, a discharge within photo-electric avalanche tube 150. The data from monostable circuit 164 are fed into a signal processor 166 then a threshold circuit 168 connected with an alarm 180.

It is recognized herein that an extremely low, false alarm rate is critical in this application. Therefore, the processor's input to the threshold circuit should advantageously be subject to the temporal and statistical characteristics of both the signal and the noise. For example, the system must respond very quickly when a high count rate or a trend indicative of a high count rate indicates either a fire or sparking in close proximity to the alarm system. At the same time, since a ten meter fire located one mile away may average just three counts per minute while the noise level might average one count per minute, the processor must be responsive to any anticipated statistical variation on both signal and noise levels. That is, a low count rate trend which is nonetheless indicative of a distant fire and/or electrical arc. A conventional, digital circuit that merely integrates for ten minutes with an alarm decision threshold of thirty detected photons will fail to alarm when the count is at twenty-nine at the end of the ten minutes and then the count is reset to zero. As a result, such a conventional circuit may delay the sounding of the alarm by several crucial minutes in the event of a distant, yet approaching, fire. Therefore, the processor must be more than a simple photon counter which tracks the number of photons detected within a fixed period of time. In other words, the processor should be responsive to any trend in photon detection that is indicative of the presence of a fire.

Figure 6:
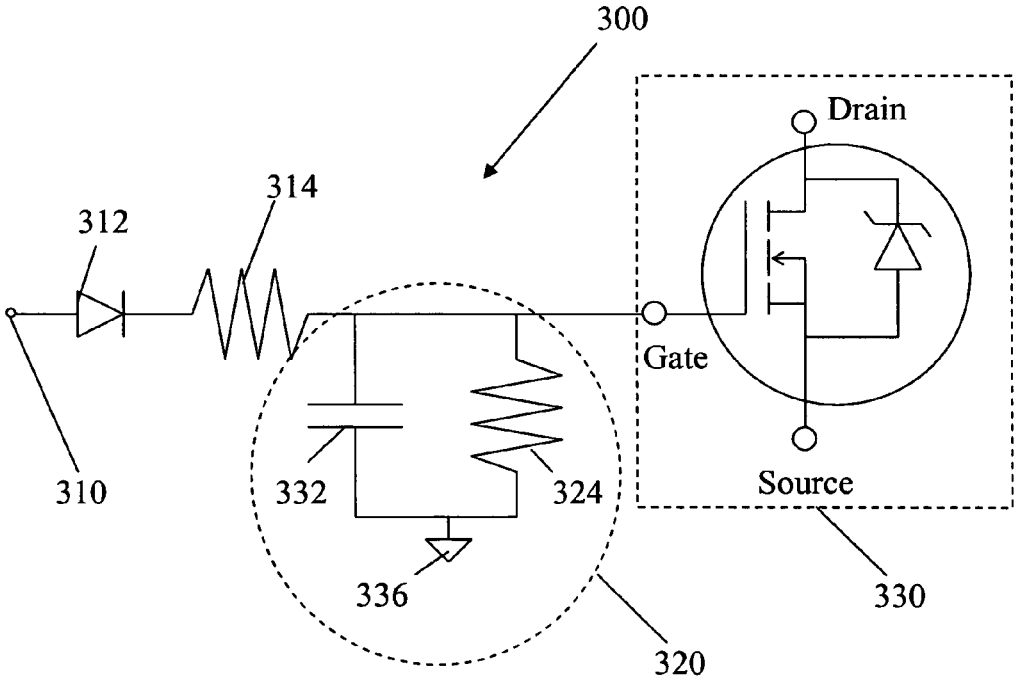
FIG. 6 is a circuit diagram illustrating a discrimination circuit which implements a highly advantageous exponentially decaying time integration.

Rather than being based on a fixed integration time, the signal/data processor of the present invention is an analog circuit functioning as a flexible integrator (also referred to as a "leaky integrator") with exponentially decaying time integration. Alternatively, it is considered that a digital version of the signal/data processor may readily be developed in view of these overall teachings disclosed herein. One embodiment of the leaky integrator includes a diode, a current limiting resistor and a parallel RC combination, with its voltage being made available to a threshold circuit. A circuit diagram of an example of a leaky integrator of the present invention is shown in FIG. 6 and generally indicated by a reference number 300. Leaky integrator 300 includes an input 310 from monostable circuit 164 of FIG. 5, a diode 312 having an anode which receives an input from monostable circuit 164. The cathode of diode 312 is connected to a current limiting resistor 314, which is, in turn, connected to a parallel RC combination 320 and a gate of a threshold circuit, shown here as a MOSFET 330. In the example illustrated in FIG. 6, current limiting resistor 314 may be a 1kΩ resistor, and parallel RC combination 320 may be formed of a 330 μF capacitor 332 in parallel with a 1 MΩ resistor 334 and a ground 336.

Figure 7:
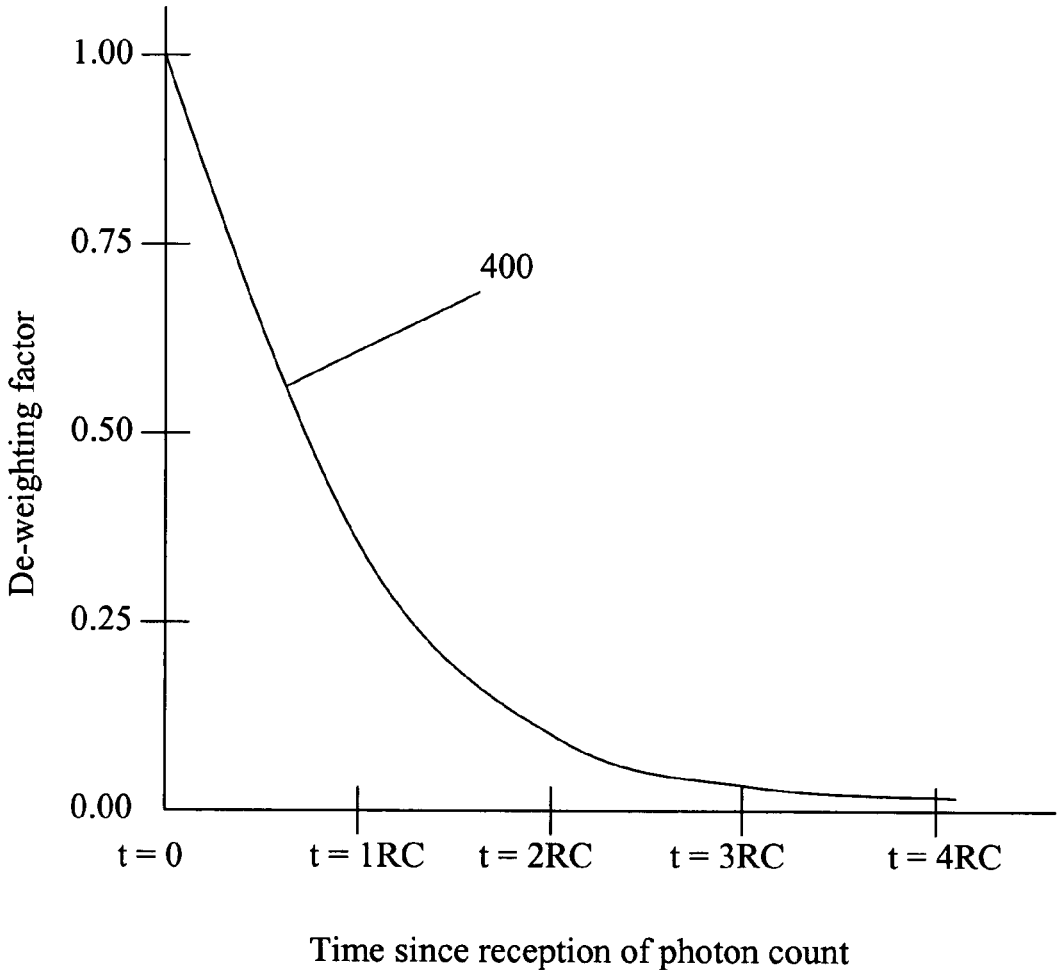
FIG. 7 is a plot showing a de-weighting factor used in the exponentially decaying time integration scheme of the present invention.

A plot 400 illustrating the de-weighting of received photon counts versus time since the photons were received at leaky integrator 300 is shown in FIG. 7. As can be seen in FIG. 7, the photon counts are de-weighted in the threshold determination such that the counts received most recently are given much higher weight in the threshold determination than the counts received earlier in time, as will be described in further detail immediately hereinafter.

The highly advantageous data processor of the present invention has numerous advantages over more complicated, conventional timer circuits because the data processor of the present invention responds to subtle, yet telling, trends in the accumulated photon count rates. The lack of a gating interval in the data processor means the count rate is never reset to zero, therefore the decision to sound the alarm is influenced by long term trends in the count rate. That is, the photon count rates are integrated in a "running" integrator circuit which continually de-weights count rates gradually over time rather than resetting to zero after a fixed time period. At the same time, the significance of a detected photon is exponentially de-weighted as time passes such that a more recent count rate is weighted more heavily than earlier count rates. The weighting function may be, for example, $e^{(-at)}$ where t is the time elapsed since the count was received and a is a selectable constant. In terms of the circuit components shown in FIG. 6, the value of a is equal to 1/RC, where R is the resistance value of resistor 334 and C is the capacitance value of capacitor 332. This exponentially decaying time integration of photon count rates is particularly advantageous when a fire is small or distant but is increasing in size. Furthermore, the leaky integrator functions to maintain a state of "high alert" when the count rate has been moderately high for some time. Consequently, in this high alert state, a slight increase in the count rate would be sufficient to immediately trigger the alarm. Therefore, the advantage of the leaky integrator signal processor in detection of small and/or distant fires in the presence of noise are derived from the unique ability of the circuitry to simultaneously take into account: a) the long term integral of the count rate; b) the mid term mean count rate; and c) the near term derivative of the count rate. That is, the leaky integrator signal processor is capable of avoiding ambiguities related to Poisson or "shot" noise in the signal.

Figure 8:
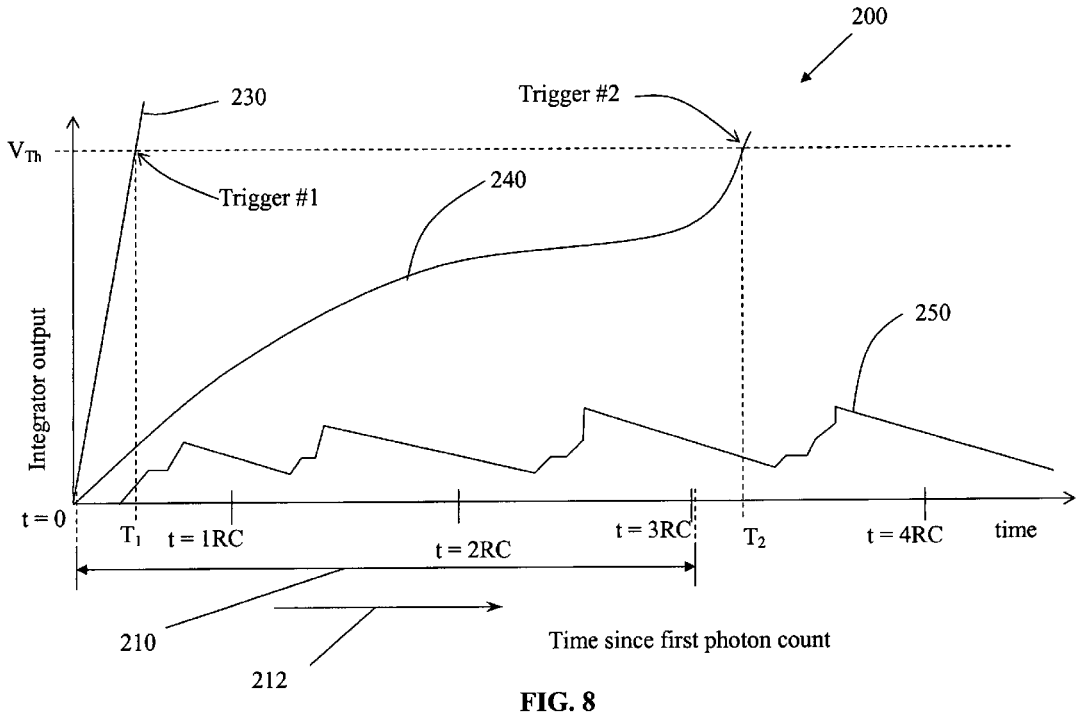
FIG. 8 is a schematic of the moving event window and flexible trigger concept of the present invention.

The data processing provided by the leaky integrator in a couple of different event scenarios or trends is illustrated in FIG. 8. FIG. 8 is an axis arrangement 200 showing the integrator output (e.g., the signal at the gate of MOSFET 330 in FIG. 6) versus time, and diagrammatically illustrating two possible scenarios for triggering an alarm to be triggered in the system. An event window 210, indicated by a double-headed arrow, refers to the photon counting time window during which the photo-electric avalanche tube in the system of the present invention is receptive to UVC radiation counts. Event window 210 moves continuously forward in time, as indicated by arrow 212, so as to track the photon count rate over a specified length of time even if a low but steady photon count rate is received at the photo-electric avalanche tube. Plot 230 is an example where a steady high photon count rate is received at the photo-electric avalanche diode during event window 210. The leaky integrator may be set to trigger an alarm if such a steady increase to a given threshold value (indicated as $V_{Th}$ in the figure) occurs at a time $T_1$. Plot 240 is a case where a low but steady photon count rate is received at the photo-electric avalanche diode over an extended time period. In such cases, the leaky integrator may be set to trigger an alarm if a sudden increase to the threshold value occurs such that, in essence, the leaky integrator is on an extended state of high alert until a small but sudden increase in photon count rate is detected. FIG. 8 also illustrates the integrator output in the presence of only cosmic ray background noise. Plot 250 illustrates the integrator output from an extraneous noise source, such as cosmic ray background signal. Although a steady count of cosmic ray signals may be received by the system, the integrator discriminates such background signals from the other trends that are indicative of fire. As a result, the integrator output does not reach the threshold voltage and, therefore, does not trigger the alarm. 144 The present invention also provides reduced power consumption over prior art fire alarm systems by combining CMOS circuitry with an enhancement-mode MOSFET. A conventional fire alarm system with CMOS circuitry used in the high voltage generator and the monostable circuit draws approximately 140 μA combined. Typically, a low power consumption CMOS operational amplifier (op-amp) would be used as a threshold circuit in conventional systems. However, the use of such an op-amp essentially doubles the current consumption of the overall system, thereby cutting the potential battery life in half. In the system of the present invention, the leaky integrator circuit draws an average of just 40 μA in the absence of UVC from a flame. The leaky integrator circuit is combined with an enhancement-mode MOSFET such that the onset of drain current is used as a threshold. Therefore, the threshold device, unlike a conventional comparator circuit, draws no current until such time as the decision is made to trigger the alarm. The present combination of the leaky integrator circuit with the enhancement-mode MOSFET as the decision circuitry allows a AA battery life of over one year.

In one embodiment of the present invention, the previously described Hamamatsu UV TRON R2868 is customized in order to make this sensor useful in the application of long distance flame and electrical arc detection. In particular, the R2868 is pretreated using what is believed to be a heretofore unknown process for modifying the spectral responsivity characteristics of the photo-electric avalanche tube. The details of this "pre-conditioning" process, which is generally referred to as a photo-annealing process, are described in detail immediately hereinafter.

The photo-annealing process of the present invention generally involves driving the R2868 at a photo-annealing voltage as high as 1.3 times the manufacturer specified maximum voltage and, simultaneously, exposing the device to light having wavelengths at which the responsivity is to be reduced. In customizing the spectral responsivity of R2868 to fire detection applications, for example, the GM tube would be exposed to sunlight during the high voltage application such that the resulting device would essentially be unresponsive to terrestrial solar radiation (i.e., be "solar blind"). That is, the photo-annealing process of the present invention requires operating the R2868 under operating conditions specifically warned against by the manufacturer, namely at voltages above the recommended maximum voltage and in the presence of sunlight. The result of the photo-annealing process is a customized GM tube which is substantially unresponsive to UVA and UVB radiation. Therefore, although the R2868 sensor has relatively low responsivity at the UVC wavelength range of interest (particularly between 230nm and 280nm), the photo-annealed sensor can be driven at long term, operating voltages between the manufacturer recommended maximum voltage and 1.2 times the $V_{max}$ while maintaining an acceptable SNR to obtain sufficient signal in the UVC wavelength range in the presence of even distant wildfires and electrical arcs.

An exemplary photo-annealing procedure is outlined below:

a. Apply a photo-annealing voltage of 1.3 times the recommended maximum voltage to the GM tube.
b. Expose the GM tube, during the high voltage application, to sunlight.

It has been found that the resulting GM tube, after the photo-annealing procedure, is essentially solar blind. That is, the photo-annealed GM tube is capable of being driven at higher voltages in order to increase the sensitivity of the device to UVC radiation in the 230 to 280nm band while the SNR remains at acceptable levels due to the insensitivity of the device to UVA and UVB radiation. The resulting GM tube, therefore, is particularly suitable for long distance wildfire and electrical arc detection which depends on weak UVC signal detection even in daytime, sunlight conditions. The GM tube so treated by the method of the present invention exhibits high sensitivity in the 230–280nm band that is sufficient to reliably warn of a flame 10 meters in diameter at a distance of 1600 meters and, when combined with the aforedescribed integrating circuit, the system is capable of triggering an alarm signal in less than 15 minutes.

While the photo-annealing process is used in the example above to modify the spectral responsivity characteristics of a GM tube, the process may also be applicable to other photon sensors for modifying the responsivity characteristics thereof.

It should be noted that, since GM tubes exhibit individual variations in spectral responsivity characteristics, a certain percentage of GM tubes may be sufficiently "solar blind" so as to be suitable for the present application of long distance flame detection, particularly when combined with the exponentially decaying time integration method of the present invention. However, it has been found that the average GM tube used in strict accordance with the manufacturer's recommendations will not yield the desired performance in a long distance flame detector for a variety of reasons. Firstly, Applicant has found that the GM tube must subjected to a higher bias voltage than the recommended $V_{max}$ value in order to sufficiently increase its sensitivity to UVC light of 230nm to 280 nm, thereby tripling the responsivity of the GM tube to UVC in comparison to its responsivity in this wavelength range at the manufacturer recommended voltage. Secondly, Applicant has found that the plots showing the responsivity peak and the solar spectrum as shown in the manufacturer's specification sheet are misleading because these plots do not take into account the fact that sunlight is much higher in intensity than the UVC radiation emitted by a distant flame. Therefore, although the responsivity plot seems to suggest that the responsivity goes to zero at certain wavelengths, the relative difference in responsivity between the signal wavelength and solar wavelengths must be, for instance, a factor of a billion at 295nm and a trillion at 315nm. The quoted indoor noise specification, as shown in the manufacturer's specification sheet, is 10 cpm. However, in order for the system to function adequately, this noise value must be less than I cpm in sunlight conditions at elevated bias voltage operating conditions, since, when noise counts go up by a factor of ten, sensitivity of the GM tube is driven down by a factor of ten. These differences in desired performance and non-ideal responses can make the difference between timely alerting to the presence of a fire and delaying the emission of an alarm signal until after the flame has grown too large to fight it effectively. Thirdly, detection of remote flames of interest, which may produce just four or five photon counts per minute, requires extremely long integration times to reduce the occurrence of false alarms due to, for example, cosmic rays and signal-shot noise ambiguities. For example the circuit board sold with the Hamamatsu R2868 is designed to trigger an alarm signal when three to nine photon counts are received within a two second interval. It is submitted that this trigger condition is insufficient for the detection of distant flames. On the other hand, the use of the aforedescribed photo-annealing process in combination with the exponentially decaying time integration method of the present invention may raise the yield to nearly 100% and ensure that the GM tube used in the remote wildfire detector system of the present invention will exhibit the appropriate spectral responsivity characteristics necessary to function as an effective device.

It is emphasized that long range flame/electrical arc detection hinges on the recognition by Applicant that the UVC wavelengths around 250nm (which are emitted by flames from electrical arcs as well as burning vegetation) are transmitted through $O_2$ but not by $O_3$. Since a nickel cathode's responsivity at 250nm is significantly higher than the responsivity at 280 nm, a GM tube with, for instance, a nickel cathode is recognized to be suitable for long distance flame detection.

Although each of the aforedescribed embodiments have been illustrated with various components having particular respective orientations, it should be understood that the present invention may take on a variety of specific configurations with the various components being located in a wide variety of positions and mutual orientations and still remain within the spirit and scope of the present invention. Furthermore, suitable equivalents may be used in place of or in addition to the various components, the function and use of such substitute or additional components being held to be familiar to those skilled in the art and are therefore regarded as falling within the scope of the present invention. For example, a variety of materials, such as nickel, molybdenum, tungsten and combinations thereof, may be used as a photocathode within the GM tube. Also, a filter may be used in conjunction with the GM tube in order to further block wavelengths shorter than 230 nm. Additionally, "blinders" or shutters may be attached to the detector system of the present invention so as to prevent the detector system from being triggered by nearby, controlled fire sources such as cigarettes or barbecue grills. A hygrometer, such as those based on hygroscopic calcium chloride or magnesium chloride as a resistor in parallel with resistor 324 of FIG. 6, may also be added to the flame detection system of the present invention. Such a hygrometer would function to reduce the RC time constant when humidity is high. In this way, the flame sensor would be at maximum sensitivity only when conditions are very dry, thereby reducing the likelihood of an unwanted false alarm resulting from the presence of controlled, non-wildfire UVC sources (such as an arc-welder, bug-zapper, tiki-torch, etc.) at times of high humidity when the urgency of detection is reduced. As another modification, the alarm signal produced by the system may be fed into a phone dialer to automatically notify authorities when the homeowner is not home, for instance. For example, an entire fire district may be covered by an autonomous array of such detectors by networking them to a plurality of fire department officers in order to avoid the possibility of a single-point failure to alert authorities to the presence of a fire.

Therefore, the present examples are to be considered as illustrative and not restrictive, and the invention is not to be limited to the details given herein, but may be modified within the scope of the appended claims.

What is claimed is:

1. An apparatus for detecting a presence of at least one of a wildfire and an electrical arc burning proximate to Earth's surface, said wildfire and said electrical arc being characterized by a wavelength that is emitted by the wildfire and electrical arc and which transmits in a first way at the Earth's surface as a result of a first ratio of oxygen compounds proximate to the surface of the Earth, but which wavelength transmits in a second way in Earth's stratosphere based on a second different ratio of oxygen compounds present in Earth's stratosphere wherein said wildfire and said electrical arc are characterized by emission of ultraviolet (UV) radiation at said detection wavelength, said apparatus comprising:

a detection arrangement disposed such that said wavelength travels from said wildfire to the detection arrangement in the presence of said first ratio of said oxygen compounds and so that sunlight arriving at said detection arrangement travels through Earth's stratosphere so as to subject the sunlight to said second ratio of oxygen compounds in a way which attenuates content of the detection wavelength in the sunlight, said detection arrangement being configured to respond at the detection wavelength so as to enhance a detection response to the wildfire while attenuating the detection response to the wavelength to sunlight based on said first and second ratios of said oxygen compounds and said detection arrangement includes:

a Geiger-Mueller tube (GM tube), which GM tube exhibits a given response at a maximum rated bias voltage when exposed to said detection wavelength as well as when concurrently exposed to a plurality of extraneous noise sources for use in generating a pulse output;

a driver for operation said GM tube in a way which produces a modified response of the GM tube, thereby increasing sensitivity of the GM tube over said given response with respect to said detection wavelength as well as with respect to the plurality of extraneous noise sources so as to increase a relative number of pulses in the pulse output responsive to the detection wavelength and responsive to the extraneous noise sources, as compared to operating said GM tube at the maximum rated bias voltage;

a processing circuit for generating an intermediate output responsive to said pulse output for use in tracking a trend in the pulse output, which trend is generally responsive to the presence of a least one of said wildfire and said electrical arc, irrespective of the increase in the relative number of pulses in the pulse output that are responsive to said extraneous sources; and an alarm apparatus for producing an alarm signal based on a predetermined characteristic of said intermediate output.

2. The apparatus of claim 1 wherein said GM tube is treated for reducing sensitivity of the GM tube to at least certain ones of said plurality of extraneous noise sources.

3. The apparatus of claim 2 wherein said GM tube exhibits a sensitivity within the 230–280 mm band that is at least 25 dB higher then at 280 nm and 100 dB higher than at 320 nm.

4. The apparatus of claim 2 wherein said GM tube is coated with an antistatic material that is transmissive with respect to said detection wavelength.

5. A method for detecting a presence of at least one of a wildfire and an electrical arc burning proximate to Earth's surface wherein said wildfire and said electrical arc are characterized by emission of ultraviolet (UV) radiation at said detection wavelength, said method comprising:

selecting a detection wavelength that is emitted by the wildfire and said electrical arc and which transmits in a first way at the Earth's surface as a result of a first ratio of oxygen compounds proximate to the surface of Earth, but which detection wavelength transmits in a second way in Earth's stratosphere based on a second, different ratio of oxygen compounds present in Earth's stratosphere;

using a detection arrangement positioned such that the detection wavelength travels from said wildfire to the detection arrangement in the presence of said first ratio of said oxygen compounds in a way which attenuates content of the detection wavelength in the sunlight; and configuring said detection arrangement to respond to the detection wavelength in the sunlight based on said first and second ratios of said oxygen compounds, and using, as part of said detection arrangement, a Geiger-Mueller tube (GM tube) having a given response at a maximum rated bias voltage when exposed to said detection wavelength, as well as when concurrently exposed to a plurality of extraneous noise sources, to generate a pulse output by operating said GM tube so as to produce a modified response of the GM tube, thereby increasing sensitivity of the GM tube over said given response with respect to said detection wavelength, as well as with respect to the plurality of extraneous noise sources, so as to increase a relative number of pulses in the pulse output, responsive to the detection wavelength and responsive to the extraneous noise sources, as compared to operating said GM tube at the maximum rated bias voltage.

6. The method of claim 5 including generating an intermediate output responsive to said pulse output for tracking a trend in the pulse output, which trend is generally responsive to the presence of at least one of said wildfires and electrical arc, irrespective of the increase in the relative number of pulses in the pulse output that are responsive to said extraneous sources.

7. The method of claim 6 wherein said intermediate output is generated responsive to pulses occurring within an event window that continuously terminates at present time and extends backward therefrom by a selected time duration.

8. The method of claim 6 including producing an alarm signal based on a predetermined characteristic of said intermediate output.

9. The method of claim 5 wherein said GM tube includes a maximum operating voltage and wherein increasing sensitivity of the GM tube over said given response, with respect to said detection wavelength, includes operating said GM tube by applying an operating bias voltage which is greater than said maximum rated bias voltage.

10. The method of claim 5 further comprising treating said GM tube in a way which reduces a sensitivity of the GM tube to at least certain ones of said plurality of extraneous noise sources.

11. The method of claim 10 wherein said GM tube is configured for a high sensitivity to the wavelength range between 230 nm to 280 nm and for a reduced sensitivity to a wavelength longer than 280 nm such that the detection arrangement is essentially solar blind above 280 nm where said reduced sensitivity is less than said height sensitivity.

12. The method of claim 10 wherein said treating includes coating at least said GM tube with an antistatic material that is transmissive with respect to said detection wavelength.

13. The method of claim 10 wherein said treating includes applying pre-conditioning voltage to said GM tube, said pre-conditioning voltage being higher than said maximum rated bias voltage, and during application of said pre-conditioning voltage, exposing said GM tube to a least certain light generating ones of said plurality of extraneous noise sources.

14. The method of claim 13 wherein exposing said GM tube includes subjecting said GM tube to sunlight during application of said pre-conditioning voltage.

15. A method for detecting a presence of a wildfire and/or an electrical arc burning near the Earth's surface wherein said wildfire and said electrical arc are characterized by emission of a range of ultraviolet (UV) radiation, said method comprising:

selecting a detection wavelength that is emitted by the wildfire and the electrical arc in said range of ultraviolet radiation such that said detection wavelength includes a first transmission characteristic through $O_2$ proximate to the surface of the Earth for the detection wavelength as emitted, and a second transmission characteristic through stratospheric $O_3$, for the detection wavelength as contained by sunlight, such that the detection wavelength that is emitted by the wildfire and the electrical arc is capable of propagating to a detection location near the surface of the Earth, subject to said first transmission characteristic, and the detection wavelength is, at least to an approximation, eliminated from sunlight, by said second transmission characteristic, that reaches the detection location;

positioning a detection arrangement at the detection location for monitoring an intensity of the detection wavelength;

configuring the detection arrangement with (i) a Gieger-Mueller tube (GM tube), which GM tube exhibits a given response at a maximum rated bias voltage when exposed to said detection wavelength as well as when concurrently exposed to a plurality of extraneous noise sources for use in generating a pulse output and (H) a driver for operating said GM tube over said given way which produces a modified response of the GM tube, thereby increasing sensitivity of the GM tube over said given response with respect to said detection wavelength as well as with respect to the plurality of extraneous noise sources so as to increase a relative number of pulses in the pulse output responsive to the detection wavelength and responsive to the extraneous noise sources, as compared to operating said GM tube at the maximum rated bias voltage;

generating an intermediate output, responsive to said pulse output, for use in tracking a trend in the pulse output, which trend is generally responsive to the presence of at least one of said wildfire and said electrical arc, irrespective of the increase in the relative number of pulses in the pulse output that are responsive to said extraneous sources; and producing an alarm signal, based on a predetermined characteristic of said intermediate output.

16. The method of claim 15 including treating said GM tube for reducing sensitivity of the GM tube to at least certain ones of said plurality of extraneous noise sources.

* * * * *